US005578425A

United States Patent [19]

Dickerson et al.

[11] Patent Number: 5,578,425

[45] Date of Patent: Nov. 26, 1996

[54] DISPOSABLE ELEMENT FOR CLEANING RADIOGRAPHIC FILM PROCESSING SOLUTIONS

[75] Inventors: Robert E. Dickerson, Hamlin; Kevin W. Williams, Rochester, both of N.Y.

[73] Assignee: Eastman Kodak Company, Rochester, N.Y.

[21] Appl. No.: 561,503

[22] Filed: Nov. 20, 1995

[51] Int. Cl.[6] ..... G03C 5/00; G03C 5/44

[52] U.S. Cl. ..... 430/347; 430/508; 430/510; 430/517; 430/584; 430/486; 430/221; 430/944

[58] Field of Search ..... 430/508, 944, 430/510, 517, 221, 486, 584, 347

[56] References Cited

U.S. PATENT DOCUMENTS 4,144,065 3/1979 Lambert et al. ..... 430/221

5,244,771 9/1993 Jandrue et al. ..... 430/517

5,260,178 11/1993 Harada et al. ..... 430/508

*Primary Examiner*—Geraldine Letscher

*Attorney, Agent, or Firm*—Carl O. Thomas

[57] ABSTRACT

An element for cleaning processing solutions contained in a radiographic film processor is disclosed. The element is comprised of a transparent film support and hydrophilic colloid layers coated on opposite sides of the film support. An infrared opacifying dye is contained within the element capable of reducing specular transmission through the element before, during and after processing to less than 50 percent, measured at a wavelength within the spectral region of from 850 to 1100 nm. A processing solution soluble colorant can be contained in one or more of the hydrophilic colloid layers.

8 Claims, No Drawings

DISPOSABLE ELEMENT FOR CLEANING RADIOGRAPHIC FILM PROCESSING SOLUTIONS

FIELD OF THE INVENTION

The invention is directed to elements for cleaning processing solutions contained in radiographic film processors.

BACKGROUND

Radiographic films are those intended to be imagewise exposed to X-radiation. The films contain on one or both sides of a film support a silver halide emulsion that, when imagewise exposed and processed, is capable of creating a visible image in the form of developed silver.

It is the prevailing practice to process radiographic films in 90 seconds or less. For example, the Kodak X-OMAT 480 RA ™ rapid access processor employs the following processing cycle:

Development 24 seconds at 35° C.

Fixing 20 seconds at 35° C.

Washing 20 seconds at 35° C.

Drying 20 seconds at 65° C.

with 6 seconds being taken up in film transport between processing steps.

A typical developer (hereinafter referred to as Developer A) exhibits the following composition:

Hydroquinone 30 g

Phenidone ™ 1.5 g

KOH 21 g $NaHCO_3$ 7.5 g $K_2SO_3$ 44.2 g $Na_2S_2O_3$ 12.6 g

NaBr 35.0 g

5-Methylbenzotriazole 0.06 g

Glutaraldehyde 4.9 g

Water to 1 liter/pH 10.0

A typical fixer exhibits the following composition:

Ammonium thiosulfate, 60% 260.0 g

Sodium bisulfite 180.0 g

Boric acid 25.0 g

Acetic acid 10.0 g

Water to 1 liter/pH 3.9–4.5

Radiographic film processors such as RA 480 are capable of exposing large amounts of film over extended periods of time (e.g., a month or more) before its processing solutions are drained and replaced. Extended use of the processing solutions is made possible by the addition of developer and fixer replenishers to compensate for developer and fixer losses by evaporation and film pick up.

One problem that results from the extensive use of processing solutions is often the build up of oily deposits and/or particulates that float to the surface of the processing solutions. These build ups occur when the processor has been allowed to stand idle for an extended period—e.g., overnight or over a weekend.

One solution is to use the first radiographic film run through the processor on start up each morning as a cleaning element. In other words, the film is used to scavenge the unwanted build up in the processing solutions and is discarded after it leaves the processor.

This has been recognized to waste valuable silver contained in the radiographic element that is discarded. Therefore cleaning elements have been offered for sale that contain only a hydrophilic colloid coated on a film support. This approach works on simple processors, but not those that rely on sensors to detect the presence of radiographic film to turn on and turn off the processor. Typically turn on and turn off is controlled by infrared sensors, which cannot detect a cleaning element containing only a hydrophilic colloid coating.

Another problem that is encountered using cleaning elements (or radiographic film that is used for the same purpose) is that the processor operator has no way of knowing whether a particular element has been previously used. Thus, there is a risk that previously used cleaning element in being used once or perhaps several times previously will not be fully effective in cleaning the processing solutions.

Harada et al U.S. Pat. No. 5,260,178 has noted that if the silver halide coating coverage of a radiographic element is quite low, it is impossible for sensors that rely on the attenuation of near infrared sensor beams by silver halide grains to sense the presence of the film in the processor. Hence replenishers are not automatically added to the processing solutions, and the useful life of the processing solutions is markedly decreased. To overcome this problem Harada et al suggested adding to radiographic elements having low silver halide coating coverages an aggregated tricarbocyanine dye having at least two acidic (e.g., sulfonic acid or carboxylic acid) substituents and an absorption peak that is bathochromically shifted by at least 50 nm when aggregated as compared to its absorption in solution. The dye as aggregated in the radiographic film attenuates the infrared sensor beam to provide the necessary signal to turn on the processor. However, once the dye has entered the processing solution (as is insured by the presence of the acidic groups and limiting other substituents), it is no longer capable of attenuating the infrared sensor beam. Instead developed silver is used to control processor shut off. When the beam of the sensor controlling shut off ceases to be attenuated by developed silver, thereby indicating the film has passed through the processor, the processor is automatically turned off.

RELATED PATENT APPLICATION

Gray et al provisional U.S. Ser. No. 60/000,634, filed Jun. 29, 1995, commonly assigned, titled CYANINE DYES WITH CHAIN SULFONE SUBSTITUENT, discloses tricarbocyanine dyes to be useful to supplement the signal sent by silver halide grains in a photographic element to an imagesetter. Substitution to allow the dyes to be washed from the film is specifically contemplated.

SUMMARY OF THE INVENTION

In one aspect the invention is directed to an element for cleaning processing solutions contained in a radiographic film processor comprising a transparent film support and hydrophilic colloid layers coated on opposite sides of the film support, wherein an infrared opacifying dye is contained within the element capable of reducing specular transmission through the element before, during and after processing to less than 50 percent, measured at a wavelength within the spectral region of from 850 to 1100 nm.

The cleaning elements of the invention are capable of providing functionally similar processor start up and shut down signals as those provided by radiographic film.

In a preferred form the cleaning elements additionally contain colorants to allow visual discrimination between cleaning elements that have and have not passed through a radiographic processor.

DESCRIPTION OF PREFERRED EMBODIMENTS

The invention is directed to a cleaning element intended for use with a conventional radiographic film processor that relies on radiographic film sensors for start up and shut down. Specifically, the start up and shut down sensors each employ an infrared (IR) beam directed toward the film and a beam detector. Attenuation of the beam at the detector signals the presence of a radiographic film. A sensor located upstream of the development stage of the processor can provide a signal to start up the processor and/or to add replenisher to the developer and fixer. A sensor located downstream of the fixer stage can provide a signal to shut down the processor and/or to discontinue replenisher addition. A radiographic film attenuates the IR beam of the start up sensor by silver halide grains refracting the IR beam. That is, the transmission path of the beam is angularly deflected sufficiently that the detector of the start up sensor sends a signal of lower IR receipt used to ready the processor for film processing. As the radiographic film is processed it develops a significant IR density as a result of silver being produced during development. Thus, as the radiographic film passes the shut down sensor, the beam of this sensor is attenuated by developed silver in the film. Subsequently, when the beam of the shut down sensor is no longer attenuated, this provides a signal that the radiographic film has passed beyond this point in the processor, allowing for a timely discontinuance of replenisher addition and/or shut down of the processor.

In the cleaning elements of the invention hydrophilic colloid layers are coated on the opposite sides of a film support. No silver halide is incorporated in the cleaning element and, hence, the cleaning element cannot rely on silver halide to turn on the processor or developed silver to activate the shut down sensor for turning off the processor.

The cleaning elements of the invention employ the same conventional film support and hydrophilic colloid materials used to form the radiographic elements used with the processors. To facilitate the physical compatibility of the cleaning element with the processor it is contemplated that the hydrophilic colloid coating density and hardening levels as well as the support thicknesses will be within the ranges of the radiographic elements intended to be used with the same processor.

The function of the hydrophilic colloid layers is to clean the processing solutions. Because of the similarities of the hydrophilic colloid layers of the cleaning elements to the hydrophilic colloid layers of radiographic films to be used in the same processor, the hydrophilic colloid layers remove the same types of unwanted materials as the radiographic elements and hence protect subsequently processed radiographic elements from picking up unwanted materials contained in or on the processing solutions.

The film support and hydrophilic colloid materials are transparent to near infrared radiation. That is, they are incapable of significantly attenuating infrared radiation in the 850 to 1100 nm spectral range of the near infrared beam detection sensors used to control radiographic film processors.

To allow the cleaning elements to be used with processors having near infrared sensors for controlling start up and shut down, it is contemplated to incorporate in the cleaning element an infrared opacifying dye capable of reducing specular transmission through the cleaning element before, during and after processing to less than 50 percent (preferably less than 25 percent), measured at a wavelength within the spectral region of from 850 to 1100 nm. For example, if the near IR sensors employ 920 nm lasers, the dye as incorporated in the cleaning element must reduce specular transmission through the cleaning element at 920 nm to less than 50 percent and, preferably, less than 25 percent. Since the sensor beam is limited to 920 nm wavelength radiation, the presence or absence of adsorption by the dye at other wavelengths is immaterial. The most efficient infrared opacifying dye choice would be a dye having a maximum absorption at (i.e., within ±10 nm) the wavelength of the sensor beams. Dyes having half peak absorption bandwidths that overlap the wavelength of the sensor beams are practically acceptable choices. The half peak absorption bandwidth of a dye is the spectral range in nm over which it exhibits a level of absorption equal to at least half of its peak absorption ($\lambda_{max}$).

The infrared opacifying dye can be located within the cleaning element at any convenient location. It can be incorporated in the support, coated on the support in one or both of the hydrophilic colloid layers, or coated in a separate layer coated between the support and the hydrophilic colloid layer(s)—e.g., in a subbing layer. The preferred location for the infrared opacifying dye is in the hydrophilic colloid layers. No extra coating step is required, and the dyes are not subjected to the elevated temperatures typically encountered in support fabrication.

When the infrared opacifying dye is added in the hydrophilic colloid layers penetrated by processing solutions, the dye must be water insoluble. Thus, for coating in this location infrared opacifying dyes are preferred that are water insoluble. The insoluble dye can be added to the hydrophilic colloid in a water miscible solvent, such as methanol. Alternatively the insoluble dye can be added to the hydrophilic colloid in the form of solid dye particles. The maximum size of the dye particles is limited only by coating convenience. Preferably the dye particles have a mean size of less than 100 micrometers.

The infrared opacifying dyes can be selected from among conventional dyes known to exhibit a half peak bandwidth that is at least partially located within the spectral region of from 850 to 1100 nm. Water solubility can be reduced with little or no impact on absorption merely by altering the choice of substituents. Generally ionic substituents, such as acidic groups, increase water solubility while nonpolar and particularly higher molecular weight nonpolar substituents decrease water solubility.

Dyes in the cyanine dye class are preferred infrared opacifying dyes. These dyes contain an odd number of methine (—CH=) or substituted methine groups linking two basic nuclei. The synthesis of dyes in the cyanine dye class having the required absorption in the 850 to 1100 nm range is particularly convenient, since the absorption of these dyes can be extended to longer wavelengths merely by increasing the number of methine groups linking the two basic nuclei. In preferred steric forms the dyes aggregate and exhibit bathochromically shifted absorptions. Generally absorption in the spectral region of from 850 to 1100 nm can be realized when 7, 9 or 11 methine groups link the basic nuclei of a cyanine dye. Such dyes are termed tricarbocyanine, tetracarbocyanine and pentacarbocyanine dyes, respectively. These methine linkages can be and are usually substituted. A very common substitution, often used to promote aggregation, is for the middle (meso) methine group to be substituted. In a preferred dye selection the meso methine group and the two adjacent methine groups form part of a 5 or 6 membered ring.

Tricarbocyanine, tetracarbocyanine and pentacarbocyanine dyes are illustrated by Simpson et al U.S. Pat. No. 4,619,892, Parton et al U.S. Pat. Nos. 4,871,656, 4,975,362, 5,061,618 and 5,108,882, Davies et al U.S. Pat. No. 4,988,615, Friedrich et al U.S. Pat. No. 5,009,992, Muenter et al 5,013,642, and Hamer *The Cyanine Dyes and Related Compounds*, Interscience, 1964, Chapters VIII and IX.

Particularly preferred infrared opacifying dyes are tricarbocyanine dyes satisfying the formula:

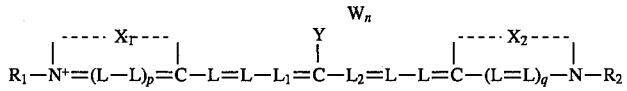

where $X_1$ and $X_2$ each independently represent the atoms necessary to complete a nucleus that with $(L—L)_p$ or $(L=L)_q$ form a 5 or 6-membered heterocyclic nucleus;

n, p and q each independently represents 0 or 1;

each L independently represents a methine group;

$L_1$ and $L_2$ are substituted methine groups that together form a 5- or 6-membered carbocyclic ring (that is, the methine carbon atoms are linked by 1,2-ethylene or 1,3-propylene groups);

$R_1$ and $R_2$ each independently represents an alkyl, sulfoalkyl or carboxyalkyl group (where the acid moieties can be present as a free acid, salt or ester);

Y represents an amino or sulfonyl group;

the alkyl moieties contain in each instance from 1 to 6 carbon atoms; and

W is a counterion to balance the charge of the molecule.

When Y is a sulfonyl group, it is preferably an $—SO_2R_3$ group, where $R_3$ is an aliphatic hydrocarbon or aromatic hydrocarbon containing from 1 to 10 carbon atoms. One or more heteroatoms (e.g., O, S, N) can be substituted for carbon in the aromatic hydrocarbon moieties. In a specifically preferred form $R_3$ is alkyl of from 1 to 6 carbon atoms.

When Y is an amino group, it can be a primary, secondary or tertiary amino group. Amino substituents when present can be independently selected from among alkyl and aryl substituents, typically each containing from 1 to 10 carbon atoms. Alternatively, when the amino is a tertiary amino substituent, the substituents can together with the amino nitrogen form a five or six membered heterocyclic ring. Piperidino and piperazino groups are preferred amino substituents.

The following are illustrations of particularly preferred infrared opacifying dyes:

IROD-1

Anhydro-3,3'-bis(3-sulfobutyl)-10,12-ethylene-11-[4-(N,N-dimethylthiocarbamoyl)1-piperazino]thiatricarbocyanine triethylamine salt;

IROD-2

Anhydro-3,3'-bis(3-sulfopropyl)-11-(4-ethoxycarbonyl-1-piperazino)-10,12-ethylene-5,5'-dimethoxythiatricarbocyanine triethylamine salt;

IROD-3

Anhydro-3,3'-diethyl-7,7'-disulfo-13-(4-ethoxycarbonyl-1-piperazino)-12,14-ethylene-1,1,1',1'-tetramethylbenz[e]indolotricarbocyanine hydroxide, sodium salt;

IROD-4

Anhydro-3,3'-bis(3-sulfobutyl)-10,12-ethylene-11-[4-(N,N-dimethylsulfamoyl)-1-piperazino]thiatricarbocyanine triethylamine salt;

IROD-5

Anhydro-3,3'-bis(3-sulfopropyl)-10,12-ethylene-11-piperidinothiatricarbocyanine triethylamine salt;

IROD-6

3,3'-Diethyl-10,12-ethylene-11-(4-methylpiperazino) thiatricarbocyanine perchlorate;

IROD-7

3,3'-Diethyl-10,12-ethylene-11-(2-methylpiperidino) thiatricarbocyanine perchlorate;

IROD-8

3,3'-Diethyl-10,12-ethylene-11-(2-methylpiperazino) benz[c]thiatricarbocyanine perchlorate;

IROD-9

3,3'-Diethyl-10,12-ethylene-11-diphenyl-aminothiatricarbocyanine perchlorate

IROD-10

Anhydro-3,3'-bis(3-sulfopropyl)-10,12-ethylene-11-(N,N-diphenylamino)thiacarbocyanine hydroxide, triethylamine salt;

IROD-11

Anhydro-3,3'-bis(3-sulfopropyl)-10,12-ethylene-11-(N-methyl-N-phenylaminothiacarbocyanine hydroxide, triethylamine salt;

IROD-12

3,3'-Diethyl-10,12-ethylene-11-(N,N-diphenylamino) benz[c]thiacarbocyanine perchlorate;

IROD-13

Anhydro-3,3'-bis(3-sulfopropyl)-10,12-ethylene-11-(N,N-diphenylamino)benz[c]thiacarbocyanine hydroxide, triethylamine salt;

IROD-14

Anhydro-3,3'-bis(3-sulfopropyl)-10,12-ethylene-11-(N-methyl-N-phenylamino)benz[c]thiacarbocyanine hydroxide, triethylamine salt;

IROD-15

Anhydro-3,3'-bis(2-sulfoethyl)-12,14-propylene-13-methylsulfonyl-1,1,1',1'-tetramethylbenz[e]indolotricarbocyanine hydroxide, sodium salt;

IROD-16

Anhydro-3,3'-bis(3-sulfopropyl)-12,14-propylene-13-methylsulfonyl-1,1,1',1'-tetramethylbenz[e]indolotricarbocyanine hydroxide, sodium salt;

IROD-17

Anhydro-3,3'-bis(3-sulfobutyl)-13-methylsulfonyl-12,14-propylene-1,1,1',1'-tetramethylbenz[e]indolotricarbocyanine hydroxide, sodium salt;

IROD-18

Anhydro-3,3'-bis(3-sulfobutyl)-13-methylsulfonyl-12,14-propylene-1,1,1',1'-tetramethylbenz[e]indolotricarbocyanine hydroxide, sodium salt;

IROD-19

Anhydro-3,3'-bis(3-sulfopropyl)-12,14-ethylene-13-methylsulfonyl-1,1,1',1'-tetramethylbenz[e]indolotricarbocyanine hydroxide, sodium salt;

IROD-20

3,3'-Diethyl-11-ethylsulfo-10,12-propylenebenz[c]thiacarbocyanine perchlorate.

In the preferred form of the invention a processing solution soluble colorant is present in the hydrophilic colloid layers. The function of the colorant is to provide a visibly distinct change in the hue of the cleaning element when it has passed through a radiographic film processor. This avoids inadvertent reuse of the cleaning element and thereby insures that a previously unused cleaning element is run through the processor and that maximum cleaning is realized.

Fortuitously, on holding for a few days in solution, dyes satisfying formula I containing a meso-piperazino substituent which includes a substituent to the 4-position of the piperazine ring, show a small, but significant transition to a processing solution soluble dye that exhibits visible absorption. Thus, by choosing the age of the dye solution to be coated, a useful mixture of an infrared opacifying dye and a processing solution colorant is incorporated into the hydrophilic colloid layers. The rate of further infrared opacifying dye transition to colorant is greatly slowed after the coating is formed. Hence, the cleaning elements are sufficiently stable in their dye composition to allow for convenient storage periods before use. The infrared opacifying dye and its transition product perform two separate functions, and there is no need to provide another colorant. In the list above of preferred infrared opacifying dyes IROD-1, IROD-2, IROD-3 and IROD-4 are illustrations of infrared opacifying dyes that are capable of providing a processing solution soluble colorant. When the infrared opacifying dye solution is relied upon to provide also the processing solution soluble colorant, the infrared opacifying dye must necessarily be located in a processing solution permeable portion of the cleaning element (e.g., a hydrophilic colloid layer).

When the infrared opacifying dye does not itself provide a colorant, it is preferred to add a separate processing solution soluble colorant to the cleaning element. The processing solution soluble colorant can take any convenient conventional form. It is, for example, well known to incorporate filter and absorbing dyes in photographic elements that are removed or decolorized during processing. Such materials are illustrated by *Research Disclosure*, Vol. 365, September 1994, Item 36544, Section VIII. Absorbing and scattering materials, B. Absorbing materials. *Research Disclosure* is published by Kenneth Mason Publications, Ltd., Dudley House, 12 North St., Emsworth, Hampshire P010 7DQ, England.

The hydrophilic colloid materials employed to form the hydrophilic colloid layers can be chosen from among the same conventional materials to used to form the processing solution penetrable layers of radiographic elements. The most commonly employed hydrophilic colloids are gelatin and gelatin derivatives. A listing of hydrophilic colloids (including hardeners) useful as coating vehicles in forming processing penetrable layers in photographic elements is provided in *Research Disclosure*, Item 36544, Section II. Vehicles, vehicle extenders, vehicle-like addenda and vehicle related addenda. The various addenda accompanying hydrophilic colloid coatings in radiographic elements to facilitate their coating or handling, such as plasticizers, lubricants, surfactants, and the like, can also be present in the cleaning elements, although they are not required. Such addenda are illustrated by *Research Disclosure*, Item 36544, Section IX. Coating physical property modifying addenda. Addenda incorporated into radiographic elements to modify silver halide imaging properties serve no useful purpose in the cleaning elements, since the cleaning elements do not contain silver halide.

The film supports onto which the hydrophilic colloid layers are coated can take any convenient conventional form. They are preferably constructed to have physical handling properties similar to those of the radiographic films used in the processor to be cleaned. The simplest possible approach is to employ as supports for the cleaning elements the same supports used to construct the radiographic elements to be handled by the processor. For example, the supports can take any of the forms disclosed in *Research Disclosure*, Vol. 184, August 1979, Item 18431, Section XII. Film Supports, and *Research Disclosure*, Item 36544, Section XV. Supports. Radiographic element supports are typically transparent, either entirely clear or blue tinted. Subbing layers coated on opposite faces of the support are typically present to facilitate hydrophilic colloid adhesion to the support surfaces. To insure dimensional stability radiographic supports are typically formed of polyesters such as poly(ethylene terephathalate) or poly(ethylene naphthenate).

EXAMPLES

The invention can be better appreciated by reference to the following specific embodiments. All coating coverages, indicated parenthetically, are in mg/dm$^2$, except as otherwise indicated.

EXAMPLE 1

Comparison Element A

A comparison element was prepared consisting of a gelatin coating (24.6) on each side of a transparent 170 μm poly(ethylene terephthalate) film support. The gelatin layers were hardened with bis(vinylsulfonylmethyl)ether (0.5 wt. %, based on gelatin).

Example Cleanup Element B

Comparison Element A was modified by the addition of infrared opacifying dye IROD-1 (0.11) to the gelatin layers.

Example Cleanup Element C

Example Cleanup Element B was modified by doubling the concentration of infrared opacifying dye IROD-1 (0.22).

Element Detection Test

Elements A, B and C were each passed through a Kodak XOMAT 480 RA ™ rapid access radiographic film processor 10 times to test the effectiveness of IROD-1 to activate radiographic film detector sensors. The processing cycle and solutions used are described above in the Background section of the specification. Sensor detection of the elements was noted in terms of the replenisher pump being turned on.

Element A in passing through the processor 10 times did not in any instance cause the replenisher pump to be turned on. Elements B and C caused the replenisher pump to be turned on during each pass through the processor. This demonstrated the effectiveness of Elements B and C to reduce the specular transmission of the gallium arsenide (920 nm) sensor sufficiently to mimic the presence of a radiographic film in the processor.

Example 2

The spectral absorption profile of samples of infrared opacifying dye IROD-1 were examined in a spectrophotometer by adding methanol to 5 mL of dye to a total volume of 1 L. Absorption was measured through a 10 mm cell.

Sample 1

IROD-1 was examined on the same day it was synthesized. The dye exhibited a peak absorption density of about 6.6 in solution at about 740 nm with a faint second peak density of <0.04 at about 520 nm.

Sample 2

IROD-1 was examined 4 days after it was synthesized and placed in solution, with intervening storage under room conditions. The dye exhibited a peak absorption density of about 6.2 in solution at about 740 nm with a second peak density of about 0.06 at about 530 nm.

Sample 3

IROD-1 was examined 7 days after it was synthesized and placed in solution, with intervening storage under room conditions. The dye exhibited a peak absorption density of about 5.6 in solution at about 740 nm with a second peak density of about 0.06 at about 530 nm.

From these observations it was deduced that IROD-1 was slowly generating a second dye with an absorption peak in the visible spectrum in solution. Samples 2 and 3 exhibited a distinct pink color.

Example 3

A cleanup element similar to Cleanup Element B was prepared using a sample of IROD-1 that had been held for 1 day following synthesis. Examination of the coating revealed a main absorption peak at 940 nm exhibiting a density of about 1.38 with a very small absorption peak at 538 nm exhibiting a density of about 0.09. The coating had a distinctly pink appearance. Examination of a sample stored for several months under the conditions of radiographic film storage revealed on significant change in its optical density.

After processing as described in Example 1, the main absorption peak remained unchanged at 940 nm, but the 538 nm absorption peak was absent, as was the pink appearance. This indicated that the colorant formed from dye IROD-1 had been cleared from the element during processing, thus providing a visual indication that the cleanup element had been previously run through the processor.

The cleanup element was run through the processor 10 additional times and again examined. No change in the absorption profile of the cleanup element was observed compared that of the element after a single pass through the processor.

Example 4

In comparing the absorption peak ($\lambda_{max}$) of IROD-1 in Examples 2 (in methanol) and 3 (in gelatin) it is noted that the dye exhibited a bathochromic shift in $\lambda_{max}$ in the gelatin coating.

Listed below are series of comparably measured methanol and gelatin absorption peaks of infrared opacifying dyes that can be used in the cleaning elements of the invention:

TABLE I

| Dye | $\lambda_{max}$ (nm) MeOH | Gel |
|---|---|---|
| IROD-1 | 737 | 941 |
| IROD-2 | 758 | 950 |
| IROD-3 | 736 | 868 |
| IROD-4 | 744 | 958 |
| IROD-5 | 715 | 886 |
| IROD-6 | 725 | 920 |
| IROD-7 | 710 | 870 |
| IROD-8 | 745 | 920 |
| IROD-9 | 790 | 1010 |
| IROD-10 | 790 | 1030 |
| IROD-11 | 810 | 1080 |
| IROD-12 | 830 | 1093 |
| IROD-13 | 830 | 1080 |
| IROD-14 | 850 | 1025 |
| IROD-15 | 872 | 890 |
| IROD-16 | 872 | 890 |
| IROD-17 | 872 | 890 |
| IROD-18 | 872 | 890 |

The invention has been described in detail with particular reference to preferred embodiments thereof, but it will be understood that variations and modifications can be effected within the spirit and scope of the invention.

What is claimed is:

1. An element for cleaning processing solutions contained in a radiographic film processor comprising a transparent film support and hydrophilic colloid layers which are free of silver halide coated on opposite sides of the film support, wherein a processing solution soluble colorant is contained in one or both of the hydrophilic colloid layers and an infrared opacifying dye is contained within the element capable of reducing specular transmission through the element before, during and after processing to less than 50 percent, measured at a wavelength within the spectral region of from 850 to 1100 nm.

2. An element according to claim 1 wherein the opacifying dye is capable of reducing specular transmission through the element before, during and after processing to less than 25 percent, measured at a wavelength within the spectral region of from 850 to 1100 nm.

3. An element according to claim 1 wherein the opacifying dye exhibits an absorption peak in the spectral region of from 850 to 1100 nm.

4. An element according to claim 1 wherein the opacifying dye satisfies the formula:

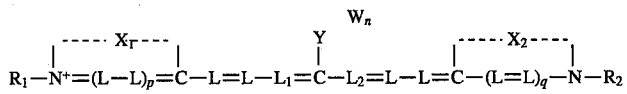

where $X_1$ and $X_2$ each independently represent the atoms necessary to complete a nucleus that with $(L—L)_p$ or $(L=L)_q$ form a 5 or 6-membered heterocyclic nucleus;

n, p and q each independently represents 0 or 1;

each L independently represents a methine group;

$L_1$ and $L_2$ are substituted methine groups that together form a 5- or 6-membered carbocyclic ring;

$R_1$ and $R_2$ each independently represents an alkyl, sulfoalkyl or carboxyalkyl group;

Y represents a piperadino or pyrazino group;

the alkyl moieties contain in each instance from 1 to 6 carbon atoms; and

W is a counterion to balance the charge of the molecule.

5. An element according to claim 4 wherein Y is a piperazino substituent which at its 4-position has a alkyloxycarbonyl, aminosulfo, or thiocarbamoyl substituent.

6. An element according to claim 1 wherein the infrared opacifying dye and the colorant are both present in one or both of the hydrophilic colloid layers and the colorant is a decomposition product of the infrared opacifying dye.

7. An element according to claim 6 wherein the colorant is a decomposition product of a tricarbo-cyanine infrared opacifying dye containing a 4-thiocar-bamoyl-1-piperazino meso methine substituent.

8. An element for cleaning processing solutions contained in a radiographic film processor comprising a transparent film support and hydrophilic colloid layers which are free of silver halide coated on opposite sides of the film support, wherein, contained within the hydrophilic layers are (a) an infrared opacifying dye capable of reducing specular transmission through the element before, during and after processing to less than 50 percent, measured at a wavelength within the spectral region of from 850 to 1100 nm, the infrared opacifying dye satisfying the formula:

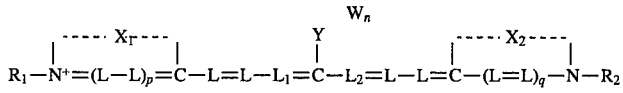

where $X_1$ and $X_2$ each independently represent the atoms necessary to complete a nucleus that with $(L—L)_p$ or $(L=L)_q$ form a 5 or 6-membered heterocyclic nucleus;

n, p and q each independently represents 0 or 1;

each L independently represents a methine group;

$L_1$ and $L_2$ are substituted methine groups that together form a 5- or 6-membered carbocyclic ring;

$R_1$ and $R_2$ each independently represents an alkyl, sulfoalkyl or carboxyalkyl group (where the acid moieties can be present as a free acid, salt or ester);

Y represents a 4-thiocarbamoyl-1-piperazino group;

the alkyl moieties contain in each instance from 1 to 6 carbon atoms; and

W is a counterion to balance the charge of the molecule; and (b) a processing solution soluble colorant which is a decomposition product of the infrared opacifying dye.

* * * * *